US008247959B2

(12) United States Patent
Beers et al.

(10) Patent No.: US 8,247,959 B2
(45) Date of Patent: Aug. 21, 2012

(54) SOLID STATE ILLUMINATION SYSTEM WITH IMPROVED COLOR QUALITY

(75) Inventors: William Winder Beers, Chesterland, OH (US); Gary Robert Allen, Chesterland, OH (US)

(73) Assignee: General Electric Company, Schenectady, NY (US)

( * ) Notice: Subject to any disclaimer, the term of this patent is extended or adjusted under 35 U.S.C. 154(b) by 641 days.

(21) Appl. No.: 12/345,820

(22) Filed: Dec. 30, 2008

(65) Prior Publication Data

US 2009/0122530 A1 May 14, 2009

Related U.S. Application Data

(63) Continuation-in-part of application No. 12/256,227, filed on Oct. 22, 2008, and a continuation-in-part of application No. 12/246,110, filed on Oct. 6, 2008, which is a continuation-in-part of application No. 11/873,463, filed on Oct. 17, 2007.

(51) Int. Cl.
*H01J 1/62* (2006.01)
*H01J 63/04* (2006.01)

(52) U.S. Cl. ..... 313/486; 313/502; 313/504; 313/489

(58) Field of Classification Search ..... 362/231, 362/84, 246, 247; 313/485, 486, 489, 502, 313/504

See application file for complete search history.

(56) References Cited

U.S. PATENT DOCUMENTS 4,847,533 A 7/1989 Hoffman
5,602,444 A 2/1997 Jansma
5,770,917 A 6/1998 Yano et al.
5,961,208 A 10/1999 Karpen
6,157,126 A 12/2000 Yano et al.
6,222,312 B1 4/2001 Ghosh et al.
6,525,460 B1 2/2003 Soules et al.
6,867,536 B2 3/2005 Srivastava et al.
6,992,432 B1 1/2006 Jansma
7,119,488 B2 10/2006 Soules et al.
7,138,757 B2 11/2006 Toth, et al.

(Continued)

FOREIGN PATENT DOCUMENTS

CA 2560656 A1 10/2005

(Continued)

OTHER PUBLICATIONS

W. Davis, Y. Ohino: "Toward an improved color rendering metric" SPIE, PO Box 10 Bellingham WA 98227-0010 USA, vol. 5941, No. 59411, 2005, pp. 1-8, XP040209336.

(Continued)

*Primary Examiner* — Ali Alavi
(74) *Attorney, Agent, or Firm* — GE Global Patent Operation; Peter T. DiMauro

(57) ABSTRACT

Disclosed herein are solid state illumination systems which provide improved color quality and/or color contrast. The systems provide total light having delta chroma values for each of the fifteen color samples of the color quality scale that are preselected to provide enhanced color contrast relative to an incandescent or blackbody light source, in accordance with specified values which depend on color temperature. Illumination systems provided herein may comprise one or more organic electroluminescent element, or they may comprise a plurality of inorganic light emitting diodes, wherein at least two inorganic light emitting diodes have different color emission bands. Methods for the manufacture of illumination systems having improved color quality and/or color contrast are also provided.

41 Claims, 5 Drawing Sheets

U.S. PATENT DOCUMENTS

| | | | | |
|---|---|---|---|---|
| 7,391,148 | B1 | 6/2008 | Setlur et al. | |
| 7,550,910 | B2 | 6/2009 | Jansma | |
| 7,670,507 | B2 | 3/2010 | Konrad et al. | |
| 7,744,243 | B2 * | 6/2010 | Van De Ven et al. | 362/231 |
| 2003/0102817 | A1 | 6/2003 | Yoo et al. | |
| 2004/0075395 | A1 | 4/2004 | Antoniadis | |
| 2004/0130256 | A1 * | 7/2004 | Juestel et al. | 313/487 |
| 2004/0144955 | A1 | 7/2004 | Chau | |
| 2005/0179358 | A1 | 8/2005 | Soules et al. | |
| 2005/0248276 | A1 | 11/2005 | Nomura et al. | |
| 2005/0258733 | A1 * | 11/2005 | Igarashi et al. | 313/487 |
| 2006/0022582 | A1 | 2/2006 | Radkov | |
| 2006/0071589 | A1 | 4/2006 | Radkov | |
| 2006/0261723 | A1 | 11/2006 | Terada et al. | |
| 2007/0223219 | A1 | 9/2007 | Medendorp, Jr. et al. | |
| 2007/0241657 | A1 * | 10/2007 | Radkov et al. | 313/483 |
| 2009/0102348 | A1 | 4/2009 | Beers et al. | |
| 2009/0102391 | A1 | 4/2009 | Beers et al. | |
| 2009/0122530 | A1 | 5/2009 | Beers et al. | |
| 2009/0134769 | A1 | 5/2009 | Cavallaro et al. | |
| 2009/0309482 | A1 | 12/2009 | Srivastava et al. | |
| 2010/0096988 | A1 * | 4/2010 | Kitabayashi et al. | 315/51 |
| 2010/0096998 | A1 | 4/2010 | Beers | |

FOREIGN PATENT DOCUMENTS

| | | | |
|---|---|---|---|
| EP | 0945894 | A1 | 9/1999 |
| JP | 2007141737 | A | 6/2007 |
| WO | 2008006205 | A | 1/2008 |
| WO | 2009/051983 | A1 | 4/2009 |

OTHER PUBLICATIONS

Y. Ohno: "Measurement of LEDs and Solid State Lighting" [Online] Oct. 18, 2007, pp. 1-49, XP002569094. Available from internet url: http://cie-cnc.ca/en/Ohno%20CNC-USNC%202007.pdf; pp. 45-46.

W. Davis: "Measuring color quality of light sources", SPIE, PO Box 10 Bellingham WA 98227-0010 USA, Vol. 6337, No. 63370, 2006, pp. 1-10, XP040229620.

International Search Report issued in connection with corresponding PCT Application No. PCT/US2009/065615 on Jan. 28, 2010.

"Phosphor Mixture for Colour-Variable Fluorescent Lamp" IP.COM, Journal, IP.Com INC., West Henrietta, NY, UA, Oct. 3, 2006. XP013116106, ISSN: 1533-0001, p. 3, Figures 4,5.

Davis & OHNO, "Color Quality Scale", Optical Engineering, vol. 49, 3 p. 053602 (Mar. 2010).

Zukauskas, Vaicekaliskas and Shur, Colour-Rendition Properties of Solid-State Lamps, Journal of Physics D: Appl. Phys., Published August 19, 2010, vol. 43, p. 345006. (http:// iopscience.ioporg/0022-3727143/351354006).

* cited by examiner

SOLID STATE ILLUMINATION SYSTEM WITH IMPROVED COLOR QUALITY

CROSS REFERENCE TO RELATED APPLICATIONS

This application is a continuation-in-part under 35 U.S.C. 120 of each of the following three prior-filed, copending, commonly-assigned U.S. patent applications, all of which are hereby incorporated by reference: Ser. No. 12/256,227, filed 22 Oct. 2008; and Ser. No. 12/246,110, filed 6 Oct. 2008, which latter application is a continuation-in-part of Ser. No. 11/873,463, filed 17 Oct. 2007.

FIELD

The present invention relates to a solid-state illumination system, and more particularly, to a solid-state illumination system with improved color quality.

BACKGROUND

Incandescent and fluorescent lighting systems are widely employed illumination systems for general use. The quality of object color under the illumination system is an important aspect of the value of such light source. For incandescent illumination systems in particular, consumers have found that incandescent bulbs sold as REVEAL® by the General Electric Company to be quite appealing, even more so than the highly desirable color of the standard incandescent lamp, due in no small part to the enhanced color contrast of the REVEAL® lamp.

In general, the quality of object color has been described in terms of color rendering, which is a measure of the degree to which the psycho-physical colors of objects illuminated by a light source conform to those of a reference illuminant for specified conditions. Color rendering as used here refers to the accurate representation of object colors compared to those same objects under a reference source.

One recent energy-efficient type of illumination system employs solid-state light emitting elements, such as light emitting diodes. In view of the appeal of the REVEAL® incandescent bulbs, a solid-state light emitting lamp with REVEAL® lighting properties, if attainable, would provide an energy-efficient light source with appealing color quality to consumers. However, there is no generally applicable mode for characterizing the appeal of the REVEAL® incandescent bulbs in such a way that it can be applied to solid-state lighting systems.

It would be desirable if there were a mode to quantify how to make light sources that generate appealing enhanced color contrast. It would also be desirable if there were solid state illumination systems having appealing enhanced color contrast.

BRIEF SUMMARY OF THE EMBODIMENTS

An embodiment of the present invention is directed to an organic electroluminescent-based illumination system which, when energized, exhibits a correlated color temperature (CCT) in the range of between about 2000 K and about 20000 K, and has an enhanced color contrast relative to an incandescent or blackbody light source. The system comprises one or more organic electroluminescent element, and optionally at least one filter, optionally at least one photoluminescent material, and optionally at least one inorganic light emitting diode. The system is configured to provide a total light that appears white when energized, the combined light having delta chroma values for each of the fifteen color samples of the color quality scale (CQS) that are preselected to provide the enhanced color contrast, in accordance with specified values.

Another embodiment of the present invention is directed to an inorganic light emitting diode-based illumination system which, when energized, exhibits a correlated color temperature (CCT) in the range of between about 2000 K and about 20000 K, and has an enhanced color contrast relative to an incandescent or blackbody light source. The system comprises a plurality of inorganic light emitting diodes, wherein at least two inorganic light emitting diodes have different color emission bands, and optionally at least one filter, optionally at least one photoluminescent material, and optionally at least one organic electroluminescent element. The system is configured to provide a combined light that appears white when energized, the combined light having delta chroma values for each of the fifteen color samples of the color quality scale (CQS) that are preselected to provide the enhanced color contrast, in accordance with specified values.

Yet another embodiment of the present invention is directed to a method of manufacturing an illumination system comprising one or more solid-state light-emitting elements, the system having a total white light with a desired color appeal. The method comprises the steps of: (a) providing an illumination system with total light having a given CCT value and given color point; (b) measuring chroma values of the total light for a plurality of the Munsell color samples of the Color Quality System; (c) calculating delta chroma values for each of the measured Munsell color samples of the Color Quality System; and (d) comparing the calculated delta chroma values to a reference set of delta chroma values for each of the measured Munsell color samples.

Other features and advantages of this invention will be better appreciated from the following detailed description.

BRIEF DESCRIPTION OF THE DRAWINGS

Advantages and features of the invention may become apparent upon reading the following detailed description and upon reference to the drawings in which.

DETAILED DESCRIPTION

Figure 1:
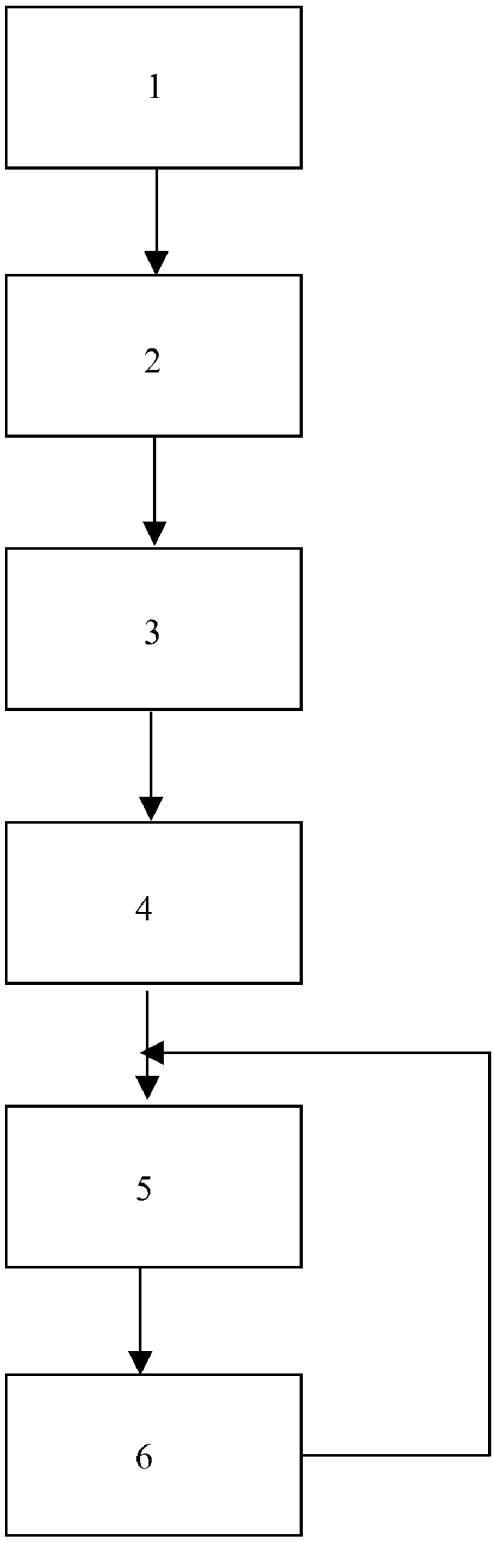
FIG. 1 is a block diagram of a method of manufacturing an illumination system, in accordance with embodiments of the disclosure.

As noted, an embodiment of the present invention is directed to an illumination system which, when energized, exhibits a correlated color temperature in the range of between about 2000 K and about 20000 K and having an improved color quality scale. In one embodiment the system comprises one or more organic electroluminescent element; and in another embodiment, the system comprises a plurality of inorganic light emitting diodes, wherein at least two of these inorganic light emitting diodes have different color emission bands. The system is configured such that when it is energized, it provides a total light that appears white. As used herein, the terms "illumination system" and "lamp" will be utilized substantially interchangeably, to refer to any source of visible light which can be generated by at least one solid-state light-emitting element. As used herein, the term "solid-state light-emitting element" typically includes an inorganic light emitting diode (e.g., LED), an organic electroluminescent element (e.g. OLED), an inorganic electroluminescent device, a laser diode, and combinations thereof, or the like. The term "total light" generally refers to the combined spectral sum of the emission of all the solid-state light-emitting element(s) in the system, as modified by any filters and/or optical facilities (to be defined hereinunder), and as modified by any phospholuminescent materials which are energized by solid-state light-emitting element. Typically, it is the total light of the illumination system which is used for general illumination.

Usually, in many solid-state light-emitting elements, such as LED's, light is emitted from a solid, often a semiconductor, rather than from a metal or gas, as is the case in traditional incandescent light bulbs, fluorescent lamps, and other discharge lamps. Unlike traditional lighting, lamps composed of solid-state light-emitting elements can potentially create visible light with less heat and less energy dissipation. In addition, its solid-state nature provides for greater resistance to shock, vibration and wear, thereby increasing its lifespan significantly.

Light emitting diodes (LED) are generally known. An LED is usually defined as a solid-state semiconductor device that converts electrical energy directly into light. In broad outline, an LED is a semiconductor device that emits optical radiation from the p-n junction when electric current is supplied in the forward direction. The output is a function of its physical construction, material used, and exciting current. Output may be in the ultraviolet, the visible, or in the infrared regions of the spectrum. The wavelength of the emitted light is determined by the band gap of the materials in the p-n junction, and is usually characterized as having a peak (or dominant) wavelength, $\lambda_p$, at which the emission is maximum, and a distribution of wavelengths, encompassing the peak wavelength, over which the emission is substantial. The distribution of wavelengths is typically characterized by a Gaussian probability density function given by $$\frac{1}{\Delta\lambda_{1/2}\sqrt{2\pi}}\exp\left(-\frac{(\lambda-\lambda_p)^2}{2\Delta\lambda_{1/2}^2}\right),$$

where $\Delta\lambda_{1/2}$ is the Gaussian half-width of the distribution function. As such, each LED is typically characterized by its perceived color, for example, violet, blue, cyan, green, amber, orange, red-orange, red, etc. Perceived color is principally determined by its peak wavelength, $\lambda_p$, even though the distribution is not monochromatic, but rather exhibits a color band having a finite spread in wavelengths of a few times $\Delta\lambda_{1/2}$, where $\Delta\lambda_{1/2}$ is typically in the range of about 5 to 50 nm. The entire wavelength range over which the LED emits perceivable light is substantially narrower than that of the entire range of visible light (about 390 to 750 nm) so that each LED is perceived as a non-white color. Additionally, individual LEDs that are nominally rated to have the same peak wavelength typically exhibit a range of peak wavelengths due to manufacturing variability. LEDs may be grouped into color bins that limit the peak wavelength to a range of allowable peak wavelengths encompassing the intended peak wavelength. A typical range of peak wavelengths defining the limits of a color bin for colored LEDs is about 5 to 50 nm.

As used herein, the term "light emitting diode" or "LED" may include a laser diode, a resonant cavity LED, superluminescent LED, flip chip LED, vertical cavity surface emitting laser, high-brightness LED or other diodic lighting device as would be understood by a person skilled in the field. Suitable light emitting diodes may comprise one or more of an inorganic nitride, carbide, or phosphide. The person of skill in the art is familiar with the wide array of commercially available LEDs and their composition and construction is well understood. In particular, as used herein, the term "inorganic light emitting diode" generally refers to those light emitting diodes where the p-n junction is predominantly constructed from inorganic materials. The term "inorganic light emitting diode" does not preclude the presence of non-inorganic materials elsewhere in a device.

As is generally understood, an OLED device typically includes one or more organic light emitting layers disposed between electrodes, e.g., a cathode and a light transmissive anode, formed on a substrate, often a light-transmissive substrate. The light-emitting layer emits light upon application of a current across the anode and cathode. Upon the application of an electric current, electrons may be injected into the organic layer from the cathode, and holes may be injected into the organic layer from the anode. The electrons and the holes generally travel through the organic layer until they recombine at a luminescent center, typically an organic molecule or polymer, which recombination process results in the emission of a light photon, which usually can be in the ultraviolet or visible regions of the spectrum. As used herein, the term "organic electroluminescent element" generally refers to a device (e.g., including electrodes and active layer) comprising an active layer having an organic material (molecule or polymer) which exhibits the characteristic of electroluminescence. A device which incorporates an organic electroluminescent element does not preclude the presence of inorganic materials. If it is specified that more than one "organic electroluminescent element" is present, the organic material may be the same (e.g., where multiple layers of the same material are arranged), or may be different (e.g., where multiple layers of different materials are arranged). Furthermore, different kinds of organic electroluminescent materials can be present (e.g., mixed) in the same layer.

As will be appreciated by one skilled in the art, an organic electroluminescent element may include additional layers such as hole transport layers, hole injection layers, electron transport layers, electron injection layers, photoabsorption layers, or any combination thereof. Organic electroluminescent elements in accordance with this disclosure may also include other layers such as, but not limited to, one or more of a substrate layer, an abrasion resistant layer, an adhesion layer, a chemically resistant layer, a photoluminescent layer, a radiation-absorbing layer, a radiation reflective layer, a barrier layer, a planarizing layer, optical diffusing layer, and combinations thereof.

The chemical composition of the organic electroluminescent material determines the "band gap" and the corresponding distribution of wavelengths of the emitted light from the luminescent center. Similar to the color band that characterizes the perceived color of an LED, the distribution of wavelengths emitted from an organic electroluminescent layer also produce a color band. However, unlike the case of the typically Gaussian shaped distribution of the LED color band, the color band of the organic electroluminescent element may have multiple peak wavelengths, and possibly a broader spectral width; nonetheless each luminescent center within an organic electroluminescent layer may be characterized by a perceived color which, having a finite distribution of wavelengths narrower than that of the entire range of visible light, may be referred to as a color band. There may be one or more different compositions of luminescent centers within each organic light-emitting layer so that each light-emitting layer may emit light in one or more color bands.

As noted, in accordance with some embodiments of the invention, the illumination system may include one or more organic electroluminescent element. The person of skill in the art is generally familiar with organic electroluminescent elements and their construction. Some embodiments of the invention include an illumination system wherein the plurality of solid-state light-emitting elements comprise a plurality of organic electroluminescent elements arranged in a stacked or overlaid configuration. As would be understood by those skilled in the field, in order to accomplish color mixing when the illumination system comprises a plurality of organic electroluminescent elements, one may include a plurality of organic electroluminescent layers fabricated on different substrates assembled in a stacked configuration. Optionally one may be overlaid over the other. In one embodiment, a transparent (e.g., adhesive) layer is used to stack together a plurality of organic electroluminescent layers. In one embodiment, such stacked organic electroluminescent layers may also include a white light emitting organic electroluminescent layer. In another embodiment of the present disclosure, the illumination system can be a tandem OLED-type lamp, which may be driven by a single power source, where white light emission can be formed by the spectral combination of, for example, red, green and blue organic electroluminescent light-emitting elements.

Some other embodiments of the invention also include an illumination system which comprises at least one photoluminescent material (typically selected from, but not limited to, phosphor, quantum dot, and combinations thereof), for converting light from one or more solid-state light emitting element to a different wavelength. Further embodiments of the invention include an illumination system which comprises at least one filter for modifying the total light of the illumination system. Suitable filters may possibly include materials which depress certain regions of the spectrum of the total light of the illumination system, such as neodymium-containing glass filters. Finally, in embodiments of an illumination system having one or more organic electroluminescent element, one may incorporate one or more inorganic light emitting diode into the system. Similarly, in embodiments of an illumination system having a plurality of inorganic light emitting diodes (wherein at least two inorganic light emitting diodes have different color emission bands), one may incorporate one or more organic electroluminescent elements into the system.

In embodiments of the disclosure, illumination systems will exhibit enhanced or improved color contrast, or an appearance that is generally more appealing than that of a traditional incandescent or blackbody light source. The color appearance of an illumination system, per se (as opposed to objects illuminated by such illumination system) is described by its chromaticity coordinates or color coordinates, which, as would be understood by those skilled in the art, can be calculated from its spectral power distribution according to standard methods. This is specified according to CIE, Method of measuring and specifying color rendering properties of light sources (2nd ed.), Publ. CIE No. 13.2 (TC-3, 2), Bureau Central de la CIE, Paris, 1974. (CIE is the International Commission on Illumination, or, Commission Internationale d'Eclairage). The CIE standard chromaticity diagram is a two-dimensional graph having x and y coordinates. This standard diagram includes the color points of black body radiators at various temperatures. The locus of black body chromaticities on the x,y-diagram is known as the Planckian locus. Any emitting source represented by a point on this locus may be specified by a color temperature, with units of kelvin. A point near but not on this Planckian locus can be characterized by a correlated color temperature (CCT), because lines can be drawn from such points to intersect the Planckian locus at this color temperature such that all points look to the normal human eye as having nearly the same color. Illumination systems can be characterized, at least in part, in terms of color coordinates and CCT. According to embodiments of the present disclosure, there are provided illumination systems which provide a total light which appears white having enhanced color contrast or chroma, or an enhanced appearance. These illumination systems provides light that is useful in illuminating objects such that the objects appear more appealing or more vibrant.

In accordance with embodiments of the invention, the illumination system is configured such that when it is energized, it provides a total light which appears white, and this combined light has delta chroma (Δ-chroma) values for each of the fifteen color samples of the Color Quality Scale (CQS) which are preselected for the correlated color temperature. The CQS will be further described hereinunder. As the term is used herein, "chroma" values are measured in the CIE LAB space. The chroma values can be calculated by conventional techniques, for example, in the CIE LAB color space. For example, the CIE 1976 a,b chroma value is calculated as $C^*_{ab}=[(a^*)^2+(b^*)^2]^{1/2}$, as would be well known to those skilled in the art, and as may be found in standard handbooks in the field such as Illuminating Engineering Society of North America Lighting Handbook (ISBN-10: 0-87995-150-8).

The CQS, as developed by the National Institute of Standards and Technology (NIST), uses fifteen Munsell color samples to evaluate aspects of the color of objects illuminated by a light source, such as that similarly done by the better-known Color Rendering Index (CRI). Now, the older CRI system utilizes fourteen standard color samples (denoted $R_1$-$R_{14}$, or $R_i$ in general) to evaluate the color rendering. Typically, when a color rendering score according to the CRI is reported, it is a "general color rendering index" (termed $R_a$), which is the average of the $R_i$ values for only the first eight samples, all of which are at low to medium chromatic saturation. The CRI system of measuring object color, however, suffers from disadvantages; for example, the red region of the color space is non-uniform and the eight color samples used to calculate the Ra are not highly saturated. Color rendering of saturated colors can be very poor even when the Ra value is high. In other words, one may (in principle) optimize the spectrum of a lamp according to a very high value of Ra, and yet the actual color rendering is much poorer; because the eight color samples are simply averaged to obtain a Ra value, a lamp can score high even though it renders one or two colors very poorly. This problem arises because too few samples of high chromatic saturation are used to calculate Ra.

CQS overcomes these disadvantages of the CRI system and is therefore used according to embodiments of this disclosure, as the system to evaluate the aspects of object color. The CQS system often uses an overall $Q_a$ value that incorporates the color appearance of a total of fifteen color samples, of which all have relatively high chromatic saturation and are substantially evenly distributed in the color space. The $Q_a$ value generally corresponds to the average of the individual CQS values for each of the fifteen color samples. Calculation of the $Q_a$ value is more fully described in W. Davis and Y. Ohno, "Toward an improved color rendering metric," Proc. SPIE Fifth International Conference on Solid State Lighting, 5941, 2005, the entire contents of which is hereby incorporated by reference.

As set by NIST, the CQS utilizes a standard set of fifteen saturated Munsell color samples (sometimes referred to as color "chips") having the hue value and chroma shown in Table I.

TABLE I

| VS of the CQS | Hue value | Chroma |
|---|---|---|
| VS1 | 7.5 P 4 | 10 |
| VS2 | 10 PB 4 | 10 |
| VS3 | 5 PB 4 | 12 |
| VS4 | 7.5 B 5 | 10 |
| VS5 | 10 BG 6 | 8 |
| VS6 | 2.5 BG 6 | 10 |
| VS7 | 2.5 G 6 | 12 |
| VS8 | 7.5 GY 7 | 10 |
| VS9 | 2.5 GY 8 | 10 |
| VS10 | 5 Y 8.5 | 12 |
| VS11 | 10 YR 7 | 12 |
| VS12 | 5 YR 7 | 12 |
| VS13 | 10 R 6 | 12 |
| VS14 | 5 R 4 | 14 |
| VS15 | 7.5 RP 4 | 12 |

These values (hue value/chroma) respectively correspond to the fifteen Munsell color samples of the CQS, which are labeled as VS1 through VS15 inclusive (i.e. VS1-VS15). In other words, VS1 corresponds to the first standard Munsell color sample, VS2 corresponds to the second Munsell color sample, and so on. The hue labels have the following descriptions: "P" is purple, "PB" is purple-blue, "B" is blue, "BG" is blue-green, "G" is green, "GY" is green-yellow, "Y" is yellow, "YR" is yellow-red, "R" is red and "RP" is red-purple.

Current industry metrics such as CRI and CQS have previously been used in such a way that the direction (or sign) of the deviation from desired values is omitted. For instance, when calculating values of Ra in the CRI system, the calculation of delta E (difference in color appearance) ignores the directionality of the deviation. If a designer of an illumination system were to use CRI or CQS in the conventional fashion, then information regarding the saturation of rendered colors would be lost. In accordance with this disclosure, applicants determine the arithmetic difference in chroma values, and therefore such directionality or sign is conserved. Furthermore, the ordinary method of using the CRI or CQS system includes the Luminance (L) portion. Applicants have however found (by calculating the difference of La*b* of reference and test samples), that inclusion of the L portion makes only a minimal contribution. Therefore, applicants typically prefer to use the chroma values.

According to embodiments of the present invention, the CQS is used in the following manner. An illumination system generates total light having chroma values for each color chip, at a given correlated color temperature (CCT) and at a given color point (or chromaticity coordinates) for the combined light. These chroma values are then compared with a reference set of chroma values for each color chip generated using a reference source. That reference source is Planckian blackbody radiation having both the same color temperature, and the same color point (chromaticity coordinates) as the illumination system under study. The delta chroma (Δ-chroma) value for each color chip under illumination by the illumination system under study, is the arithmetic difference between the chroma value of the total light of the illumination system under study, and the reference source chroma value.

Hence, this disclosure also provides a method of manufacturing an illumination system comprising one or more solid state light-emitting elements having a total white light with a desired color appeal.

Referring now to FIG. 1, is shown a block flow diagram, schematically setting forth methods in accordance with embodiments of the invention. In general, the method comprises the steps of: (a) providing (block 1) an illumination system with total light having a given CCT value and given color point; (b) measuring (block 2) chroma values of the total light for a plurality of the Munsell color samples of the Color Quality System; (c) calculating (block 3) delta chroma values for each of the measured Munsell color samples of the Color Quality System; and (d) comparing (block 4) the calculated delta chroma values to a reference set of delta chroma values for each of said measured Munsell color samples. Generally, the reference set of delta chroma values are derived from the measurement of chroma values from blackbody radiation. In some cases, the method further requires or comprises: (e) adjusting (block 5) spectral components of the illumination system to provide an illumination system with an adjusted total light at said given CCT value and given color point; and (f) measuring (block 6) chroma values of the adjusted total light for the plurality of the Munsell color samples of the Color Quality System. In many instances, step (b) comprises measuring chroma values of the combined light for all fifteen Munsell color samples of the Color Quality System. Finally, the method may further comprise more than one iteration of adjustment step (e) and measurement step (f). One may also consider this method of manufacturing an illumination system to be, from another point of view, a method of designing an improved illumination system. An illumination system is considered to have been manufactured after one assemble solid-state light-emitting elements which have a total light that falls within the desired reference chroma values.

According to embodiments, there are desirable delta chroma (Δ-chroma) values for the total light emitted by the illumination systems of the present invention. The delta chroma values are useful for identifying color perceptions and evaluating the enhanced color contrast of the illumination system described herein. The delta chroma values can be used to select, make, and/or evaluate an illumination system according to embodiments of the present disclosure.

In order to determine whether total light from an illumination system has delta chroma (Δ-chroma) values for each of the fifteen color samples of the Color Quality Scale (CQS) which are "preselected" for said correlated color temperature, one may generally follow the guidelines noted below, depending on the CCT of the illumination system. It should be noted that the target delta chroma values for a traditionally defined ideal light source (e.g. a standard incandescent lamp) have VS values of essentially zero for all 15 Munsell color chips. However, the target delta chroma values for a light source that provides enhanced color contrast and visual appeal in this disclosure can deviate significantly from a target of VS=0, in a manner which depends on the CCT. Deviations may be pronounced for VS6, VS7, VS8, VS13, VS14, VS15 for CCT values from 2000 to 4500 K; and may be pronounced for VS6, VS7, VS8, VS13, VS14 for CCT values from 4500 to 20000 K.

Therefore, if the correlated color temperature (CCT) is in the range of between about 2000 K and about 3000 K, then the delta chroma values would typically be chosen as follows. At least two of the following three color samples of the CQS are within the parameters: −2 to 7 (more narrowly, 0 to 5) for VS1; −3 to 7 (more narrowly, −1 to 5) for VS2; −7 to 7 (more narrowly, −5 to 5) for VS3. At least one of the following two color samples of the CQS are within the parameters: −2 to 8 (more narrowly, 0 to 7) for VS4; −2 to 15 (more narrowly, 0 to 14) for VS5. At least two of the following three color samples of the CQS are within the parameters: 1 to 25 (more narrowly, 3 to 20) for VS6; 4 to 26 (more narrowly, 5 to 25) for VS7; −1 to 15 (more narrowly, 2 to 10) for VS8. At least two of the following three color samples of the CQS are within the parameters: −6 to 7 (more narrowly, −2.5 to 5) for VS9; −4 to 6 (more narrowly, −2.5 to 5) for VS10; −2 to 8 (more narrowly, 0 to 5) for VS11. At least one of the following two color samples of the CQS are within the parameters: −1 to 8 (more narrowly, 0 to 6) for VS12; −1 to 13 (more narrowly, 2 to 10) for VS13. At least one of the following two color samples of the CQS are within the parameters: −7 to 13 (more narrowly, 2 to 10) for VS14; −9 to 12 (more narrowly, 2 to 10) for VS15. In accordance with this disclosure, all delta chroma values are measured in the CIE LAB space.

If the correlated color temperature is in the range of between about 3000 K and about 4500 K, then the delta chroma values would typically be chosen as follows. At least two of the following three color samples of the CQS are within the parameters: −5 to 7 (more narrowly, 0 to 5) for VS; −3 to 7 (more narrowly, −1 to 5) for VS2; −7 to 7 (more narrowly, −5 to 5) for VS3. At least one of the following two color samples of the CQS are within the parameters: −3 to 8 (more narrowly, 0 to 7) for VS4; −2 to 15 (more narrowly, 0 to 14) for VS5. At least two of the following three color samples of the CQS are within the parameters: 0 to 22 (more narrowly, 3 to 20) for VS6; 3 to 26 (more narrowly, 5 to 25) for VS7; −1 to 15 (more narrowly, 2 to 11) for VS8. At least two of the following three color samples of the CQS are within the parameters: −6 to 7 (more narrowly, −2.5 to 5) for VS9; −4 to 6 (more narrowly, −2.5 to 5) for VS10; −4 to 6 (more narrowly, 0 to 5) for VS11. At least one of the following two color samples of the CQS are within the parameters: −1 to 8 (more narrowly, 0 to 6) for VS12; −1 to 13 (more narrowly, 2 to 10) for VS13. At least one of the following two color samples of the CQS are within the parameters: −7 to 15 (more narrowly, 2 to 12) for VS14; −7 to 12 (more narrowly, 2 to 11) for VS15.

If the correlated color temperature is in the range of between about 4500 K and about 7500 K, then the delta chroma values would typically be chosen as follows. At least two of the following three color samples of the CQS are within the parameters: −5 to 7 (more narrowly, 0 to 5) for VS1; −3 to 7 (more narrowly, −1 to 5) for VS2; −5 to 7 (more narrowly, −3 to 5) for VS3. At least one of the following two color samples of the CQS are within the parameters: −3 to 7 (more narrowly, −1 to 5) for VS4; −2 to 15 (more narrowly, 0 to 10) for VS5. At least two of the following three color samples of the CQS are within the parameters: 0 to 22 (more narrowly, 3 to 15) for VS6; 1 to 26 (more narrowly, 5 to 18) for VS7; −1 to 15 (more narrowly, 2 to 12) for VS8. At least one of the following two color samples of the CQS are within the parameters: −6 to 7 (more narrowly, −2.5 to 5) for VS9; −5 to 6 (more narrowly, −2.5 to 5) for VS10; −4 to 6 (more narrowly, −2 to 5) for VS11. At least one of the following two color samples of the CQS are within the parameters: −2 to 8 (more narrowly, 0 to 6) for VS12; −1 to 16 (more narrowly, 2 to 10) for VS13. At least one of the following two color samples of the CQS are within the parameters: −5 to 22 (more narrowly, 2 to 12) for VS14; −6 to 15 (more narrowly, 0 to 11) for VS15.

If the correlated color temperature is in the range of between about 7500 K and about 20000 K, and then the delta chroma values would typically be chosen as follows. At least two of the following three color samples of the CQS are within the parameters: −3 to 7 (more narrowly, 0 to 5) for VS1; −3 to 7 (more narrowly, −1 to 5) for VS2; −5 to 8 (more narrowly, −2 to 7) for VS3. At least one of the following two color samples of the CQS are within the parameters: −3 to 6 (more narrowly, −1 to 4) for VS4; −3 to 15 (more narrowly, 0 to 10) for VS5. At least two of the following three color samples of the CQS are within the parameters: 0 to 22 (more narrowly, from 3 to 15) for VS6; 0 to 25 (more narrowly, 5 to 16) for VS7; −1 to 15 (more narrowly, from 2 to 12) for VS8. At least two of the following three color samples of the CQS are within the parameters: −5 to 7 (more narrowly, from 0 to 5) for VS9; −5 to 6 (more narrowly, −2 to 5) for VS10; −4 to 6 (more narrowly, −3 to 5) for VS11. At least one of the following two color samples of the CQS are within the parameters: −3 to 8 (more narrowly, 0 to 6) for VS12; −1 to 16 (more narrowly, 1 to 10) for VS13. At least one of the following two color samples of the CQS are within the parameters: −3 to 24 (more narrowly, from 2 to 11) for VS14; −4 to 15 (more narrowly, from 0 to 11) for VS15.

In accordance with some embodiments of the invention, a plurality of solid-state light-emitting elements in the illumination system are arranged in a grid, close packed, or other regular pattern or configuration. Non-limiting examples of such a regular pattern includes grids in a hexagonal, rhombic, rectangular, square, or parallelogram configuration, or a regular spacing around the perimeter or the interior of a circle, square, or other multi-sided plane geometric shape, for example. For optimized color mixing, it may sometimes be desirable to keep the incidence of same-color adjacency low. However, it may not always be possible to avoid same-color adjacency.

In accordance with certain embodiments of the invention, when using multiple LEDs each has a color that is characterized by the wavelength at which the emission spectrum of the LED is maximum (peak wavelength), and has a distribution of emission intensity at nearby wavelengths that is represented approximately by a Gaussian distribution function. Typically the characteristic width is about 5-50 nm. Some embodiments are directed to an illumination system where at least one solid-state light-emitting element is configured to emit light (when energized) having a peak wavelength in a range of from about 432 nm to about 467 nm, at least one solid-state light-emitting element of the system is configured to emit light when energized having a peak wavelength in a range of from about 518 nm to about 542 nm, at least one solid-state light-emitting element of the system is configured to emit light when energized having a peak wavelength in a range from about 578 nm to about 602 nm, and at least one solid-state light-emitting element of the system is configured to emit light when energized having a peak wavelength in a range of from about 615 nm to about 639 nm.

Although these varying colors for the individual solid-state light-emitting elements are effective to achieve desirable color quality (when combined), enhancement may result from the inclusion of at least two further solid-state light-emitting elements, (especially considering the present selection of commercially available LEDs), wherein at least one of the further solid-state light-emitting elements is configured to emit light when energized having a peak wavelength in a range of from about 458 nm to about 482 nm, and at least one of the further solid-state light-emitting elements is configured to emit light when energized having a peak wavelength in a range of from about 605 nm to about 629 nm.

It will be appreciated that the number of solid-state light-emitting elements cited above is dependent on the intensity of the elements as well as their peak wavelengths and distribution of wavelengths. Accordingly, the present invention is not limited in the number of types of solid-state light-emitting elements that could be used to build a desired combined spectrum of light. Thus, the invention may comprise use of solid-state light-emitting elements having the following number of different color bands: one, two, three, four, five, six, seven, eight, nine, ten, eleven, or even more numbers of different color bands. Solid-state light emitting elements emitting violet, blue, cyan, green, amber, yellow, orange, red-orange, and/or red or other intermediate or mixtures of color bands may be included. In some other embodiments, solid-state light emitting elements of four or more colors can produce white light, some non-limiting examples being: RGBA (red, green, blue, amber); RGBC (red, green, blue, cyan); and the like.

The illumination system in accordance with embodiments of this disclosure further comprises a substrate for supporting the plurality of solid-state light-emitting elements. In general, such substrate may comprise a heat dissipating element capable of dissipating heat from said system. The general purpose for such substrate includes providing mechanical support and/or thermal management and/or electrical management and/or optical management for the plurality of solid-state light-emitting elements. Substrate can be made of any suitable material, and can comprise one or more of metal, semiconductor, glass, plastic, and ceramic, or other suitable material. Printed circuit boards provide one specific example of a substrate. Other suitable substrates include various hybrid ceramics substrates and porcelain enamel metal substrates. Furthermore, one can render a substrate to be light reflecting, for example, by applying white masking on the substrate. In some cases, the substrate can be mounted in a base. An example of a suitable base includes the well-known Edison base.

In embodiments of the invention, the illumination system will further include leads for providing electric current to at least one of the plurality of solid-state light emitting elements. The leads may comprise a portion of an electrical circuit. As is generally known, illumination devices having a plurality of solid-state light-emitting elements (such as LEDs of different colors) may be controlled in both intensity and color by appropriate application of electrical current. Thus, the person skilled in this field would broadly understand the electrical circuitry needed to provide power to solid-state light-emitting elements. The present invention is not intended to be limited to a particular circuit, but rather, by characteristics of the total light of the illumination system.

In certain embodiments of the invention, the illumination system may further include at least one controller and at least one processor. Usually such processor is configured to receive a signal from a controller to control intensity of one or more of the solid-state light-emitting elements. A processor can include, e.g., one or more of microprocessor, microcontroller, programmable digital signal processor, integrated circuit, computer software, computer hardware, electrical circuit, programmable logic device, programmable gate array, programmable array logic; and the like. In some case, such controller is in communication with a sensor receptive to one or both of the total light emission (that is, the total light of the illumination system), or the temperature of the solid-state light-emitting elements. A sensor can be, for example, a photodiode or a thermocouple. The processor may in turn control (directly or indirectly) electric current to the solid-state light-emitting elements. In further embodiment, the system can further include a user interface coupled to the controller to facilitate adjustment of the total light emission or the spectral content of the emitted light.

According to some embodiments, the illumination system can comprise an envelope to at least partially enclose the plurality of solid-state light-emitting elements. Typically such envelope is substantially transparent or translucent in the direction of the intended light output. Materials of construction for such envelope may include one or more of plastic, ceramic, metal, composites, light-transmissive coatings, glass, or quartz. Such envelope can have any shape, for example, bulb shaped, dome shaped, hemispherical, spherical, cylindrical, parabolic, elliptical, flat, helical, or other.

The illumination system may include an optical facility which performs a light-affecting operation upon the light emitted by one or more of the solid-state light-emitting element. As used herein, the term "optical facility" includes any one or more element which can be configured to perform at least one light-affecting operation. Such a light affecting operation may include, but is not limited to, one or more selected from mixing, scattering, attenuating, guiding, extracting, controlling, reflecting, refracting, diffracting, polarizing, and beam-shaping. In other words, an optical facility has broad meaning sufficient to include a wide variety of elements which affect light. These light-affecting operations offered by the optical facility can be helpful in effectively combining the light from each of the solid-state light-emitting elements (where a plurality is employed), so that the total light appears white, and preferably homogeneous in color appearance as well. Operations such as mixing and scattering are especially effective to achieve homogeneous white light. Operations such as guiding, extracting, and controlling are intended to refer to light-affecting operations which extract the light from the light-emitting elements, for maximizing luminous efficiency. These operations may have other effects as well. It is understood that there is possible overlap between the terms describing the light-affecting operation (e.g., "controlling" may include "reflecting"), but the person skilled in the art would understand the terms used.

In some cases, the illumination system may include a scattering element or optical diffuser to mix light from two or more solid-state light-emitting elements. Typically, such scattering element or optical diffuser is selected from at least one of film, particle, diffuser, prism, mixing plate, or other color-mixing light guide or optic; or the like. A scattering element (e.g., an optical diffuser) may assist in obscuring individual RGB (red, blue, green, or other color) structure of different-colored solid-state light emitting elements, so that the color of the light source and the illumination upon a surface appears substantially spatially uniform in apparent color to the viewer.

In some embodiments, the optical facility can include a light guiding or shaping element selected from lens, filter, iris, and collimator; or the like. Alternatively, the optical facility can include an encapsulant for one or more of the solid-state light-emitting elements, which is configured to mix, scatter or diffuse light. In another alternative, the optical facility includes a reflector or some other kind of light-extracting elements (e.g., photonic crystals or waveguide).

As noted, according to some embodiments of the invention, one may employ a material that encapsulates individual solid-state light emitting elements (e.g., LED chips), in order to scatter or diffuse light, or to make homogeneous light. Usually, such an encapsulating material is substantially transparent or translucent. The encapsulating medium may, in some instances, be composed of a vitreous substance or a polymeric material, e.g., epoxy, silicone, acrylates, and the like. Such an encapsulating material may typically also include particles that scatter or diffuse light, which can assist in mixing light from different solid-state lighting elements. Particles which scatter or diffuse light can be any appropriate size and shape, as would be understood by those skilled in the art, and can be composed of, for example, an inorganic material such as silicon oxide, silicon, titania, alumina, indium oxide, tin oxide, or other metal oxides; and the like. In alternative embodiments, one may employ other types of diffusers and mixers to diffuse light, or to make homogeneously colored light. They could be engineered diffuser films, for example, such as those used within the LCD industry that are prism films on various polymeric materials. In addition, it is also possible to guide/shape the LED light using different other optical components to further optimize color mixing within this light source. Suitable optical components include, for example, various lenses (concave, convex, planar, "bubble", fresnel, etc.) and various filters (polarizers, color filters, etc.).

Figure 2:
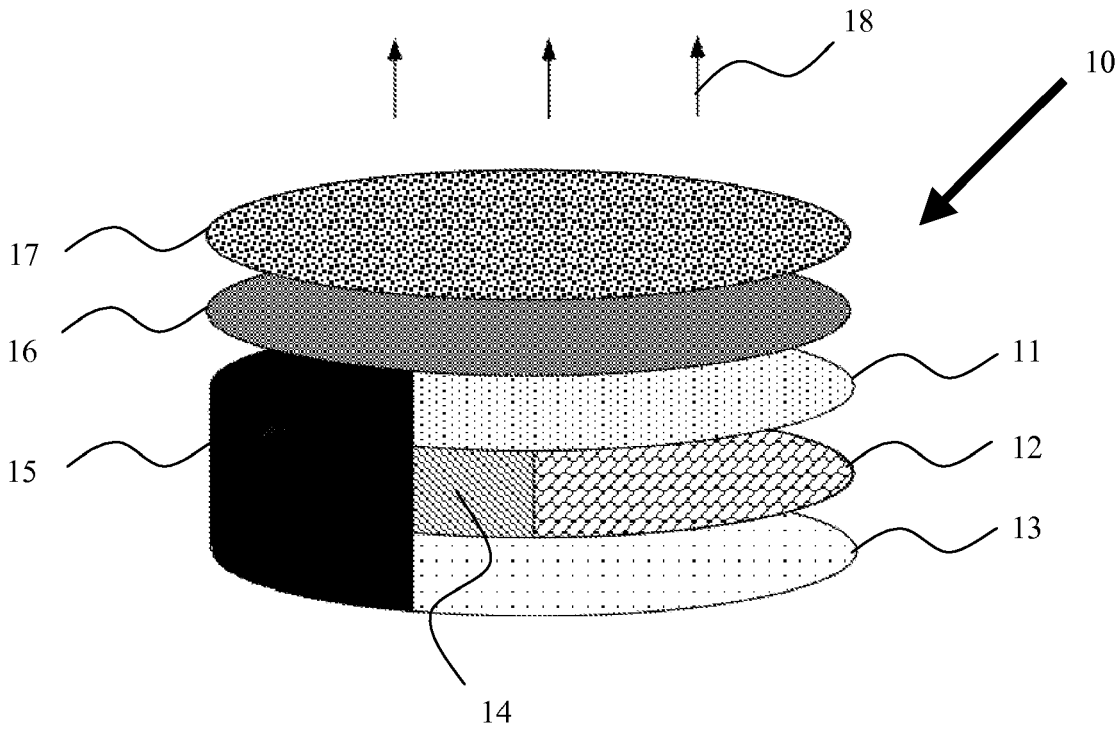
FIG. 2 depicts a schematic view of an illumination system employing a plurality of light emitting diodes, in accordance with embodiments of the disclosure.

Referring now to FIG. 2, here is shown a highly schematic view of an illustrative embodiment of a luminaire 10 which may be employed to emit a total white light 18 from an array 11 of solid-state light-emitting elements, such as LEDs. In particular, an array 11 of LED die typically may be mechanically supported in thermal communication with a heat sink 15. Electrical current is supplied to the LED array 11 from power source 13, controlled by processor/driver 14 which in turn is in communication with sensor 12. Light emitted from the individual die in the array 11 are typically mixed and/or combined by a light mixer/diffuser 16, and the mixed/combined light can be extracted by optical extraction facility 17 to emit the total white light 18.

Figure 3:
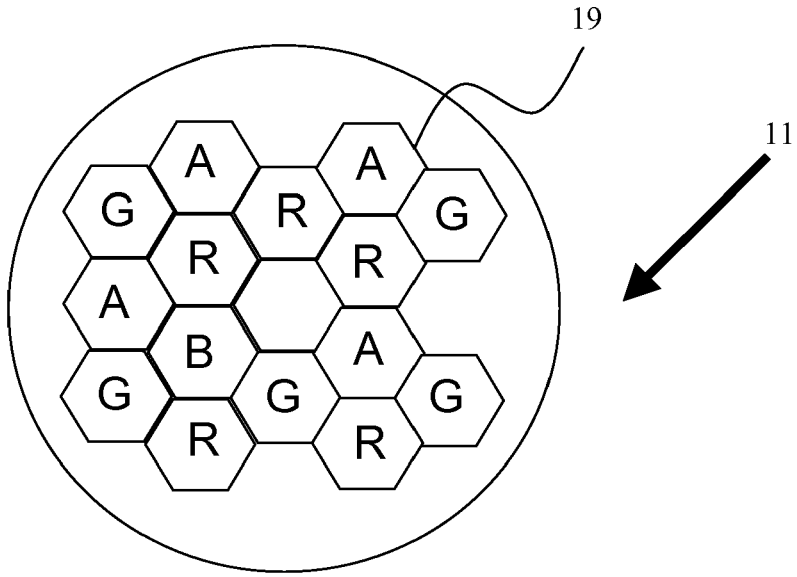
FIG. 3 depicts a configuration of light emitting diodes arrayed in a pattern, in accordance with embodiments of the disclosure.

FIG. 3 is a schematic depiction of an illustrative embodiment of LED array 11 showing typical positions of individual LED die 19. In an exemplary embodiment, an array of fifteen such die 19 are shown in a generally honeycombed arrangement, with R denoting a red LED, A for amber, G for green, and B for blue. When incorporated into luminaire 10 (see FIG. 2), this array 11 will generally be capable of supplying homogeneous white light 18.

Figure 4:
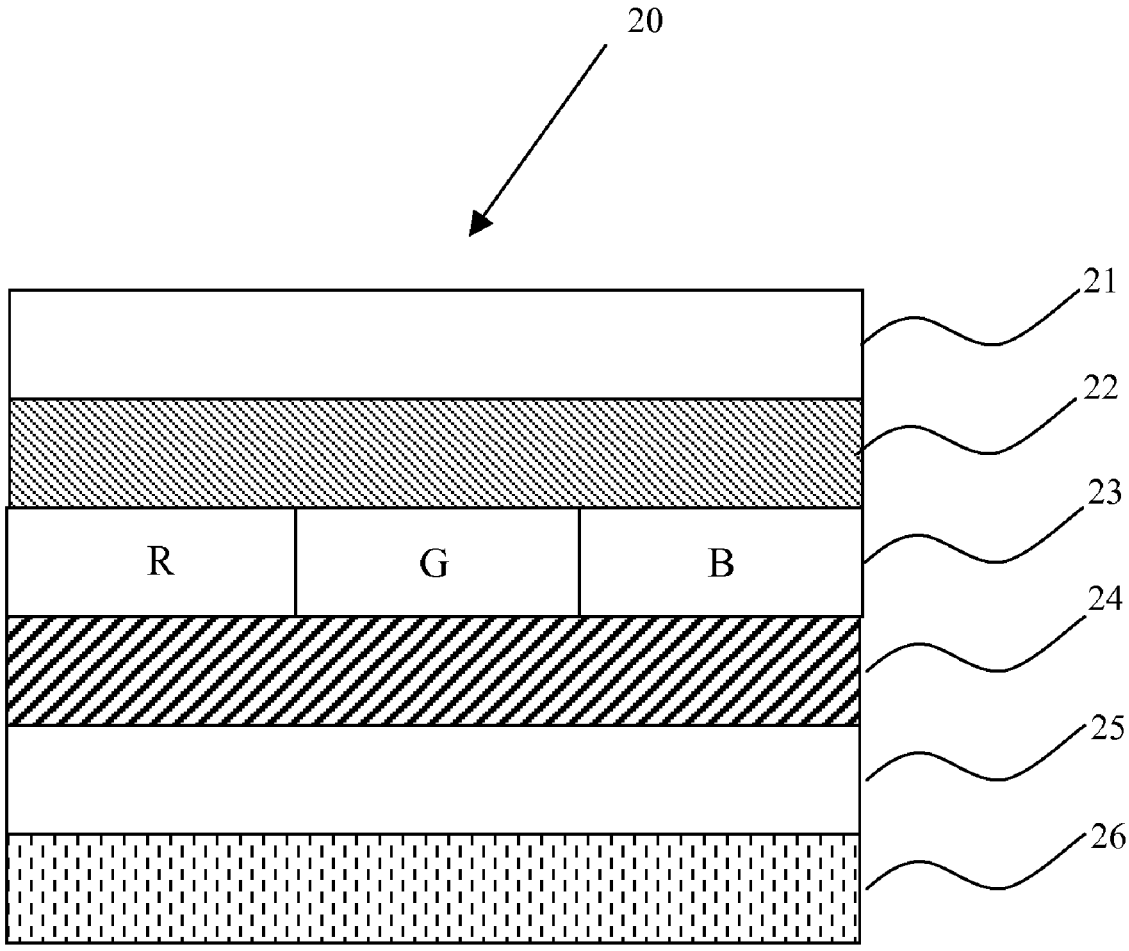
FIG. 4 depicts a schematic side-view of an arrangement of organic electroluminescent elements, in accordance with embodiments of the disclosure.

Numerous ways are possible to arrange organic electroluminescent elements in order to provide a total light which appears white. An illustrative embodiment of one such OLED configuration is shown in FIG. 4. In a schematic side-view of sequential layers is shown light-emitting system 20, which is comprised of a top substrate 21, a cathode 22, an organic electroluminescent layer 23, charge-blocking layer 24, anode 25 (which may be a transparent anode), and bottom glass substrate 26. Layer 23 may be composed of three different types of organic electroluminescent materials R, G, B, which emit color bands which are essentially red, green, and blue, respectively. Light extracted (not shown) from the bottom of device 20 can be combined to provide a white light. Although the three electroluminescent materials appear to be depicted as disposed laterally in layer 23, they may of course be disposed in other configurations (such as mixed), as would be understood by those skilled in the art.

In order to promote a further understanding of the invention, the following example is provided. This example is shown by way of illustration and not limitation.

EXAMPLE

A multi-LED illumination system was constructed from fifteen LED chips having six different colors. All chips chosen were high power single color LEDs, with a lambertian radiation pattern, from commercially available sources. All wavelength peaks observed were accompanied by typical spectral half-widths of less than 50 nm and usually less than 35 nm.

TABLE II

| Nominal color of LED | Number of Each Color LED Used | Typical Wavelength (nm) | Actual Wavelength Peak Observed (nm) |
|---|---|---|---|
| Blue | 1 | 455 | 452 |
| Cyan | 3 | 505 | 514 |
| Green | 2 | 530 | 535 |
| Amber | 4 | 590 | 594 |
| Red-Orange | 2 | 617 | 628 |
| Red | 3 | 627 | 636 |

The fifteen LED chips noted in Table II were arrayed in a honeycomb pattern on a common control circuit board with heat sink, and overlayed with a light mixing facility and a scattering element, to promote color mixing and light homogeneity.

Figure 5:
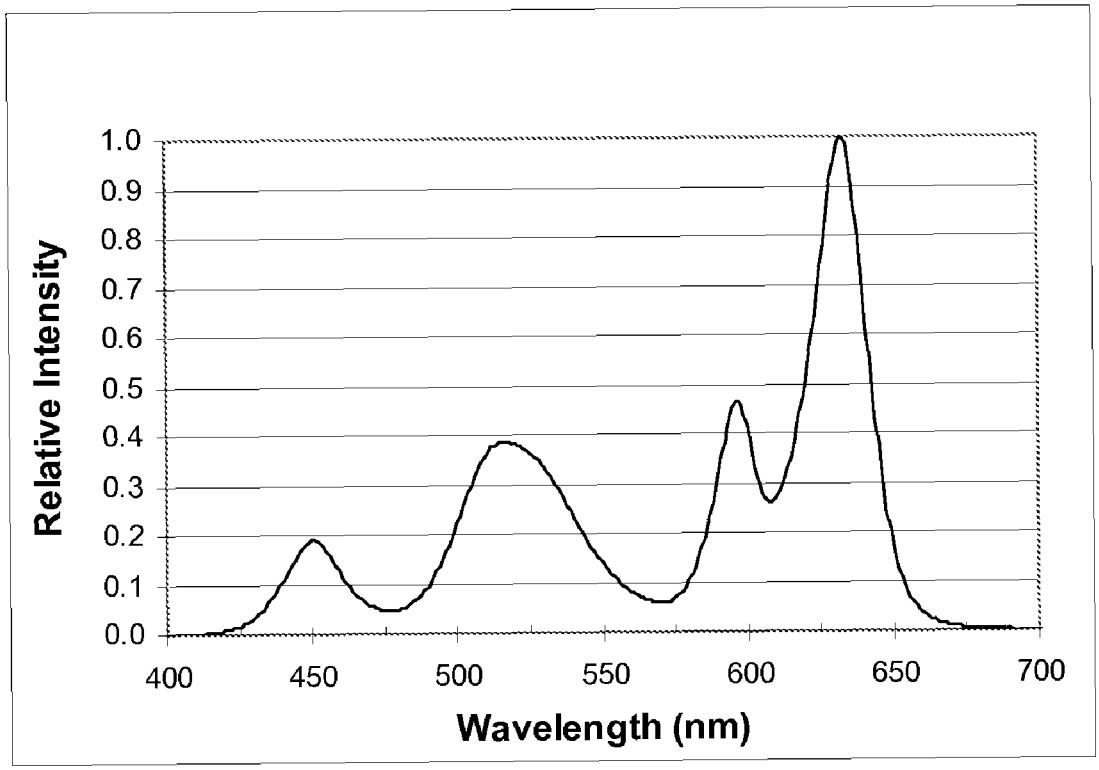
FIG. 5 is a spectrum of the total light emission of an exemplary illumination system.

The resultant spectrum from this exemplary system is shown in FIG. 5. The combined/total light extracted from the array had a color point (according to the CIE chromaticity system) of x=0.440 and y=0.3948, a CCT of 2808, and CRI ($R_a$) value of 60.2. Its aggregate $Q_a$ value in the CQS system was 80.2. The light from this lamp exhibited delta chroma values ($\Delta C^*_{ab}$) for each of the fifteen color samples of the CQS system as shown in Table III. The combined effect of the different color LED chips was to emit light which could be perceived by a viewer to be white.

TABLE III

| VS Chip | ΔC*ab |
|---|---|
| VS1 | 1.1 |
| VS2 | 0.1 |
| VS3 | −0.6 |
| VS4 | 6.6 |
| VS5 | 12.0 |
| VS6 | 18.0 |
| VS7 | 19.5 |
| VS8 | 4.7 |
| VS9 | −4.3 |
| VS10 | −2.0 |
| VS11 | 0.5 |
| VS12 | 4.5 |
| VS13 | 8.2 |
| VS14 | 8.6 |
| VS15 | 5.4 |

Figure 6:
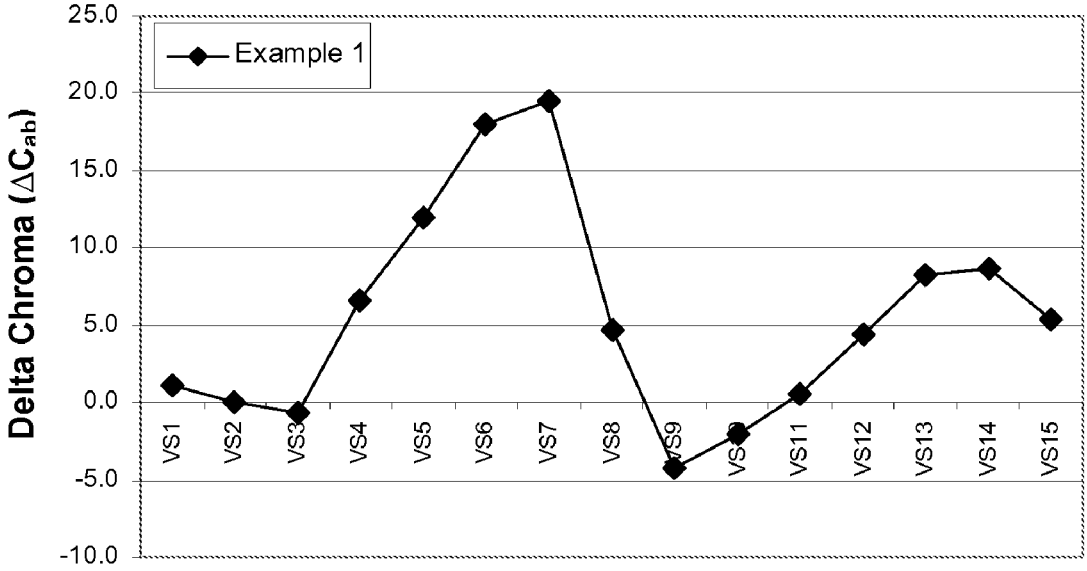
FIG. 6 is a graphical depiction of delta chroma values for an exemplary illumination system.

The CQS output noted in tabular form in Table III above is also depicted graphically in FIG. 6.

The lamp in this Example, when energized, was found to emanate light that allows objects to appear more appealing or natural. In particular, some such objects which may benefit include those having wood color, wood grain color, and skin tones. They generally approximate, or even improve upon, certain salient features of the spectrum of REVEAL® incandescent light bulbs produced by General Electric Company.

While an example has been presented utilizing LEDs as light-emitting elements, one of skill can build or adapt a lamp from a combination of LEDs and/or OLEDs and/or other solid-state light-emitting elements having the same CQS color rendering properties, by ascertaining the spectral patterns of the lamps made in accordance with this example. One would choose light emitting elements which match the spectra of the LEDs used in the inventive combination described in the example above. It is surprising that the proper selection of solid-state light-emitting elements and blending of their output will provide spectra with the same, or even improved, illuminating characteristics as REVEAL® light bulbs.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity). "Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable.

As used herein, the phrases "adapted to," "configured to," and the like refer to elements that are sized, arranged or manufactured to form a specified structure or to achieve a specified result. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed as new and desired to be protected by Letters Patent of the United States is:

1. An illumination system which, when energized, exhibits a correlated color temperature (CCT) in the range of between about 2000 K and about 20000 K, the system comprising:

one or more organic electroluminescent element;

wherein said system is configured to provide a total light that appears white when energized, said total light having delta chroma values for each of the fifteen color samples of the color quality scale (CQS) that are preselected to provide enhanced color contrast relative to an incandescent or blackbody light source, in accordance with the following:

(A) for a system having a CCT in the range of between about 2000 K and about 3000 K, the delta chroma values are as follows:

at least two color samples of the CQS are within the parameters

−2 to 7 for VS1;

−3 to 7 for VS2;

−7 to 7 for VS3;

at least one color sample of the CQS is within the parameters

−2 to 8 for VS4;

−2 to 15 for VS5;

at least two color samples of the CQS are within the parameters 1 to 25 for VS6;

4 to 26 for VS7;

−1 to 15 for VS8;

at least two color samples of the CQS are within the parameters

−6 to 7 for VS9;

−4 to 6 for VS10;

−2 to 8 for VS11;

at least one color sample of the CQS is within the parameters

−1 to 8 for VS12;

−1 to 13 for VS13; and at least one color sample of the CQS is within the parameters −7 to 13 for VS14;

−9 to 12 for VS15;

(B) for a system having a CCT in the range of between about 3000 K and about 4500 K, the delta chroma values are as follows:

at least two color samples of the CQS are within the parameters

−5 to 7 for VS1;

−3 to 7 for VS2;

−7 to 7 for VS3;

at least one color sample of the CQS is within the parameters

−3 to 8 for VS4;

−2 to 15 for VS5;

at least two color samples of the CQS are within the parameters 0 to 22 for VS6;

3 to 26 for VS7;

−1 to 15 for VS8;

at least two color samples of the CQS are within the parameters

−6 to 7 for VS9;

−4 to 6 for VS10;

−4 to 6 for VS11;

at least one color sample of the CQS is within the parameters

−1 to 8 for VS12;

−1 to 13 for VS13; and at least one color sample of the CQS is within the parameters −7 to 15 for VS14;

−7 to 12 for VS15;

(C) for a system having a CCT in the range of between about 4500 K and about 7500 K, the delta chroma values are as follows:

at least two color samples of the CQS are within the parameters

−5 to 7 for VS1;

−3 to 7 for VS2;

−5 to 7 for VS3;

at least one color sample of the CQS is within the parameters

−3 to 7 for VS4;

−2 to 15 for VS5;

at least two color samples of the CQS are within the parameters 0 to 22 for VS6;

1 to 26 for VS7;

−1 to 15 for VS8;

at least two color samples of the CQS are within the parameters

−6 to 7 for VS9;

−5 to 6 for VS10;

−4 to 6 for VS11;

at least one color sample of the CQS is within the parameters

−2 to 8 for VS12;

−1 to 16 for VS13; and at least one color sample of the CQS is within the parameters −5 to 22 for VS14;

−6 to 15 for VS15, (D) for a system having a CCT in the range of between about 7500 K and about 20000 K, the delta chroma values are as follows:

at least two color samples of the CQS are within the parameters

−3 to 7 for VS1;

−3 to 7 for VS2;

−5 to 8 for VS3;

at least one color sample of the CQS is within the parameters

−3 to 6 for VS4;

−3 to 15 for VS5;

at least two color samples of the CQS are within the parameters 0 to 22 for VS6;

0 to 25 for VS7;

−1 to 15 for VS8;

at least two color samples of the CQS are within the parameters

−5 to 7 for VS9;

−5 to 6 for VS10;

−4 to 6 for VS11;

at least one color sample of the CQS is within the parameters

−3 to 8 for VS12;

−1 to 16 for VS13; and at least one color sample of the CQS is within the parameters −3 to 24 for VS14;

−4 to 15 for VS15;

wherein all delta chroma values are measured in the CIE LAB space.

2. The illumination system in accordance with claim 1, wherein the delta chroma values are preselected in accordance with the following:

(A) for a system having a CCT in the range of between about 2000 K and about 3000 K, the delta chroma values are as follows:

at least two color samples of the CQS are within the parameters 0 to 5 for VS1;

−1 to 5 for VS2;

−5 to 5 for VS3;

at least one color sample of the CQS is within the parameters 0 to 7 for VS4;

0 to 14 for VS5;

at least two color samples of the CQS are within the parameters 3 to 20 for VS6;

5 to 25 for VS7;

2 to 10 for VS8;

at least two color samples of the CQS are within the parameters

−2.5 to 5 for VS9;

−2.5 to 5 for VS10;

0 to 5 for VS11;

at least one color sample of the CQS is within the parameters 0 to 6 for VS12;

2 to 10 for VS13; and at least one color sample of the CQS is within the parameters 2 to 10 for VS14;

2 to 10 for VS15;

(B) for a system having a CCT in the range of between about 3000 K and about 4500 K, the delta chroma values are as follows:

at least two color samples of the CQS are within the parameters 0 to 5 for VS1;

−1 to 5 for VS2;

−5 to −5 for VS3;

at least one color sample of the CQS is within the parameters 0 to 7 for VS4;

0 to 14 for VS5;

at least two color samples of the CQS are within the parameters 3 to 20 for VS6;

5 to 25 for VS7;

2 to 11 for VS8;

at least two color samples of the CQS are within the parameters

−2.5 to 5 for VS9;

−2.5 to 5 for VS10;

0 to 5 for VS1;

at least one color sample of the CQS is within the parameters 0 to 6 for VS12;

2 to 10 for VS13; and at least one color sample of the CQS is within the parameters 2 to 12 for VS14;

2 to 11 for VS15;

(C) for a system having a CCT in the range of between about 4500 K and about 7500 K, the delta chroma values are as follows:

at least two color samples of the CQS are within the parameters 0 to 5 for VS1;

−1 to 5 for VS2;

−3 to 5 for VS3;

at least one color sample of the CQS is within the parameters

−1 to 5 for VS4;

0 to 10 for VS5;

at least two color samples of the CQS are within the parameters 3 to 15 for VS6;

5 to 18 for VS7;

2 to 12 for VS8;

at least two color samples of the CQS are within the parameters

−2.5 to 5 for VS9;

−2.5 to 5 for VS10;

2 to 5 for VS11;

at least one color sample of the CQS is within the parameters 0 to 6 for VS12, 2 to 10 for VS13; and at least one color sample of the CQS is within the parameters 2 to 12 for VS14;

0 to 11 for VS15;

(D) for a system having a CCT in the range of between about 7500 K and about 20000 K, the delta chroma values are as follows:

at least two color samples of the CQS are within the parameters 0 to 5 for VS1;

−1 to 5 for VS2;

−2 to 7 for VS3;

at least one color sample of the CQS is within the parameters

−1 to 4 for VS4;

0 to 10 for VS5;

at least two color samples of the CQS are within the parameters 3 to 15 for VS6;

5 to 16 for VS7;

2 to 12 for VS8;

at least two color samples of the CQS are within the parameters 0 to 5 for VS9;

−0.2 to 5 for VS10;

−3 to 5 for VS11;

at least one color sample of the CQS is within the parameters 0 to 6 for VS12;

1 to 10 for VS13; and at least one color sample of the CQS is within the parameters 2 to 11 for VS14;

0 to 11 for VS15.

3. The illumination system of claim 1, further comprising a substrate for supporting said one or more organic electroluminescent element.

4. The illumination system of claim 3, wherein said substrate comprises a heat dissipating element capable of dissipating heat from said system.

5. The illumination system of claim 1, wherein said system further includes leads for providing electric current to the one or more organic electroluminescent element.

6. The illumination system of claim 1, said system further including at least one controller and at least one processor, wherein said at least one processor is configured to receive a signal from said controller to control intensity of emission from said one or more organic electroluminescent element.

7. The illumination system of claim 6, wherein said at least one controller is in communication with a sensor receptive to one or more of total light emission and temperature of said one or more organic electroluminescent element.

8. The illumination system of claim 6, wherein said at least one processor controls electric current to said one or more organic electroluminescent element.

9. The illumination system of claim 1, wherein said one or more organic electroluminescent element is at least partially enclosed by a transparent or translucent envelope.

10. The illumination system of claim 1, said system further comprising an optical facility configured to perform at least one light-affecting operation upon light emitted from said one or more organic electroluminescent element, said operation selected from the group consisting of mixing, scattering, attenuating, guiding, extracting, controlling, reflecting, refracting, diffracting, polarizing, and beam-shaping.

11. The illumination system of claim 10, wherein said optical facility includes a scattering element or optical diffuser to mix light.

12. The illumination system of claim 11, wherein said scattering element or optical diffuser is selected from at least one of film, particle, diffuser, prism, and mixing plate.

13. The illumination system of claim 10, wherein said optical facility includes a light guiding or shaping element selected from lens, filter, iris, and collimator.

14. The illumination system of claim 10, wherein said optical facility includes an encapsulant for said one or more organic electroluminescent element, configured to scatter or diffuse light.

15. The illumination system of claim 10, wherein said optical facility includes a reflector, or a refractive or total-internal-reflective light guide.

16. The illumination system of claim 1, wherein said one or more organic electroluminescent element comprises an electroluminescent organic molecule or an electroluminescent polymer.

17. The illumination system of claim 16, wherein said one or more organic electroluminescent element is arranged in a device comprising an active layer sandwiched between electrodes.

18. The illumination system of claim 1, comprising a plurality of active layers of said one or more organic electroluminescent element, said plurality arranged in a stacked or overlaid configuration.

19. The illumination system of claim 1, wherein said system comprises at least one filter for modifying the combined light.

20. The illumination system of claim 1, wherein said system comprises at least one photoluminescent material selected from phosphor, quantum dot, and combinations thereof, for converting light from said one or more organic electroluminescent element to a different wavelength.

21. The illumination system of claim 1, wherein said system comprises at least one inorganic light emitting diode.

22. An illumination system which, when energized, exhibits a correlated color temperature (CCT) in the range of between about 2000 K and about 20000 K, the system comprising:

a plurality of inorganic light emitting diodes, wherein at least two inorganic light emitting diodes have different color emission bands;

wherein said system is configured to provide a total light that appears white when energized, said total light having delta chroma values for each of the fifteen color samples of the color quality scale (CQS) that are preselected to provide enhanced color contrast relative to an incandescent or blackbody light source, in accordance with the following:

(A) for a system having a CCT in the range of between about 2000 K and about 3000 K, the delta chroma values are as follows:

at least two color samples of the CQS are within the parameters

−2 to 7 for VS1;

−3 to 7 for VS2;

−7 to 7 for VS3;

at least one color sample of the CQS is within the parameters

−2 to 8 for VS4;

−2 to 15 for VS5;

at least two color samples of the CQS are within the parameters 1 to 25 for VS6;

4 to 26 for VS7;

−1 to 15 for VS8;

at least two color samples of the CQS are within the parameters

−6 to 7 for VS9;

−4 to 6 for VS10;

−2 to 8 for VS11;
at least one color sample of the CQS is within the parameters
−1 to 8 for VS12;
−1 to 13 for VS13; and
at least one color sample of the CQS is within the parameters
−7 to 13 for VS14;
−9 to 12 for VS15;
(B) for a system having a CCT in the range of between about 300 K and about 4500 K, the delta chroma values are as follows:
at least two color samples of the CQS are within the parameters
−5 to 7 for VS1;
−3 to 7 for VS2;
−7 to 7 for VS3;
at least one color sample of the CQS is within the parameters
−3 to 8 for VS4;
−2 to 15 for VS5;
at least two color samples of the CQS are within the parameters
0 to 22 for VS6;
3 to 26 for VS7;
−1 to 15 for VS8;
at least two color samples of the CQS are within the parameters
−6 to 7 for VS9;
−4 to 6 for VS10;
−4 to 6 for VS11;
at least one color sample of the CQS is within the parameters
−1 to 8 for VS12;
−1 to 13 for VS13; and
at least one color sample of the CQS is within the parameters
−7 to 15 for VS14;
−7 to 12 for VS15;
(C) for a system having a CCT in the range of between about 4500 K and about 7500 K, the delta chroma values are as follows:
at least two color samples of the CQS are within the parameters
−5 to 7 for VS1;
−3 to 7 for VS2;
−5 to 7 for VS3;
at least one color sample of the CQS is within the parameters
−3 to 7 for VS4;
−2 to 15 for VS5;
at least two color samples of the CQS are within the parameters
0 to 22 for VS6;
1 to 26 for VS7;
−1 to 15 for VS8;
at least two color samples of the CQS are within the parameters
−6 to 7 for VS9;
−5 to 6 for VS10;
−4 to 6 for VS11;
at least one color sample of the CQS is within the parameters
−2 to 8 for VS12;
−1 to 16 for VS13; and
at least one color sample of the CQS is within the parameters
−5 to 22 for VS14;
−6 to 15 for VS15,
(D) for a system having a CCT in the range of between about 7500 K and about 20000 K, the delta chroma values are as follows:
at least two color samples of the CQS are within the parameters
−3 to 7 for VS1;
−3 to 7 for VS2;
−5 to 8 for VS3;
at least one color sample of the CQS is within the parameters
−3 to 6 for VS4;
−3 to 15 for VS5;
at least two color samples of the CQS are within the parameters
0 to 22 for VS6;
0 to 25 for VS7;
−1 to 15 for VS8;
at least two color samples of the CQS are within the parameters
−5 to 7 for VS9;
−5 to 6 for VS10;
−4 to 6 for VS11;
at least one color sample of the CQS is within the parameters
−3 to 8 for VS12;
−1 to 16 for VS13; and
at least one color sample of the CQS is within the parameters
−3 to 24 for VS14;
−4 to 15 for VS15;
wherein all delta chroma values are measured in the CIE LAB space.

23. The illumination system in accordance with claim 22, wherein the delta chroma values are preselected in accordance with the following:
(A) for a system having a CCT in the range of between about 2000 K and about 3000 K, the delta chroma values are as follows:
at least two color samples of the CQS are within the parameters
0 to 5 for VS1;
−1 to 5 for VS2;
−5 to 5 for VS3;
at least one color sample of the CQS is within the parameters
0 to 7 for VS4;
0 to 14 for VS5;
at least two color samples of the CQS are within the parameters
3 to 20 for VS6;
5 to 25 for VS7;
2 to 10 for VS8;
at least two color samples of the CQS are within the parameters
−2.5 to 5 for VS9;
−2.5 to 5 for VS10;
0 to 5 for VS11;
at least one color sample of the CQS is within the parameters
0 to 6 for VS12;
2 to 10 for VS13; and
at least one color sample of the CQS is within the parameters
2 to 10 for VS14;
2 to 10 for VS15;

(B) for a system having a CCT in the range of between about 3000 K and about 4500 K, the delta chroma values are as follows:

at least two color samples of the CQS are within the parameters 0 to 5 for VS1;

−1 to 5 for VS2;

−5 to −5 for VS3;

at least one color sample of the CQS is within the parameters 0 to 7 for VS4;

0 to 14 for VS5;

at least two color samples of the CQS are within the parameters 3 to 20 for VS6;

5 to 25 for VS7;

2 to 11 for VS8;

at least two color samples of the CQS are within the parameters

−2.5 to 5 for VS9;

−2.5 to 5 for VS10;

0 to 5 for VS11;

at least one color sample of the CQS is within the parameters 0 to 6 for VS12;

2 to 10 for VS13; and at least one color sample of the CQS is within the parameters 2 to 12 for VS14;

2 to 11 for VS15;

(C) for a system having a CCT in the range of between about 4500 K and about 7500 K, the delta chroma values are as follows:

at least two color samples of the CQS are within the parameters 0 to 5 for VS1;

−1 to 5 for VS2;

−3 to 5 for VS3;

at least one color sample of the CQS is within the parameters

−1 to 5 for VS4;

0 to 110 for VS5;

at least two color samples of the CQS are within the parameters 3 to 15 for VS6;

5 to 18 for VS7;

2 to 12 for VS8;

at least two color samples of the CQS are within the parameters

−2.5 to 5 for VS9;

−2.5 to 5 for VS10;

2 to 5 for VS11;

at least one color sample of the CQS is within the parameters 0 to 6 for VS12, 2 to 10 for VS13; and at least one color sample of the CQS is within the parameters 2 to 12 for VS14;

0 to 11 for VS15;

(D) for a system having a CCT in the range of between about 7500 K and about 20000 K, the delta chroma values are as follows:

at least two color samples of the CQS are within the parameters 0 to 5 for VS1;

−1 to 5 for VS2;

−2 to 7 for VS3;

at least one color sample of the CQS is within the parameters

−1 to 4 for VS4;

0 to 110 for VS5;

at least two color samples of the CQS are within the parameters 3 to 15 for VS6;

5 to 16 for VS7;

2 to 12 for VS8;

at least two color samples of the CQS are within the parameters 0 to 5 for VS9;

−0.2 to 5 for VS10;

−3 to 5 for VS11;

at least one color sample of the CQS is within the parameters 0 to 6 for VS12;

1 to 10 for VS13; and at least one color sample of the CQS is within the parameters 2 to 11 for VS14;

0 to 11 for VS15.

24. The illumination system of claim 22, wherein said plurality of inorganic light emitting diodes are arranged in a grid, a close packed configuration, or other regular pattern.

25. The illumination system of claim 22, further comprising a substrate for supporting said plurality of inorganic light emitting diodes.

26. The illumination system of claim 25, wherein said substrate comprises a heat dissipating element capable of dissipating heat from said system.

27. The illumination system of claim 22, wherein said system further includes leads for providing electric current to said plurality of inorganic light emitting diodes.

28. The illumination system of claim 22, said system further including at least one controller and at least one processor, wherein said at least one processor is configured to receive a signal from said controller to control intensity of one or more of said plurality of inorganic light emitting diodes.

29. The illumination system of claim 28, wherein said at least one controller is in communication with a sensor receptive to one or more of total light emission and temperature of one or more of said plurality of inorganic light emitting diodes.

30. The illumination system of claim 28, wherein said at least one processor controls electric current to one or more of said plurality of inorganic light emitting diodes.

31. The illumination system of claim 22, wherein said plurality of inorganic light emitting diodes are at least partially enclosed by a transparent or translucent envelope.

32. The illumination system of claim 22, said system further comprising an optical facility configured to perform at least one light-affecting operation upon light emitted from at least one of said plurality of inorganic light emitting diodes, said operation selected from the group consisting of mixing, scattering, attenuating, guiding, extracting, controlling, reflecting, refracting, diffracting, polarizing, and beam-shaping.

33. The illumination system of claim 32, wherein said optical facility includes a scattering element or optical diffuser to mix light.

34. The illumination system of claim 33, wherein said scattering element or optical diffuser is selected from at least one of film, particle, diffuser, prism, and mixing plate.

35. The illumination system of claim 32 wherein said optical facility includes a light guiding or shaping element selected from lens, filter, iris, and collimator.

36. The illumination system of claim 32, wherein said optical facility includes an encapsulant for at least one of said plurality of inorganic light emitting diodes, configured to scatter or diffuse light.

37. The illumination system of claim 32, wherein said optical facility includes a reflector, or a refractive or total-internal-reflective light guide.

38. The illumination system of claim 22, wherein at least one of said plurality of inorganic light emitting diodes comprises an inorganic nitride, carbide, or phosphide.

39. The illumination system of claim 22 wherein said system comprises at least one filter for modifying the combined light.

40. The illumination system of claim 22, wherein said system comprises at least one photoluminescent material selected from phosphor, quantum dot, and combinations thereof, for converting light from at least one of said plurality of inorganic light emitting diodes to a different wavelength.

41. The illumination system of claim 22, wherein said system comprises at least one organic electro luminescent element.

* * * * *